US006780303B2

(12) United States Patent
Colombier et al.

(10) Patent No.: US 6,780,303 B2
(45) Date of Patent: Aug. 24, 2004

(54) CONTINUOUS NICKEL PLATING PROCESS FOR AN ALUMINUM CONDUCTOR AND CORRESPONDING DEVICE

(75) Inventors: Gabriel Colombier, Saint Egreve (FR); Jean-Sylvestre Safrany, La Murette (FR); Bernard Loreau, Sucy en Brie (FR); Sandrine Tournier, Fontaine (FR)

(73) Assignee: Aluminium Pechiney, Paris (FR)

( * ) Notice: Subject to any disclaimer, the term of this patent is extended or adjusted under 35 U.S.C. 154(b) by 218 days.

(21) Appl. No.: 10/050,896

(22) Filed: Jan. 18, 2002

(65) Prior Publication Data

US 2002/0139685 A1 Oct. 3, 2002

Related U.S. Application Data

(63) Continuation-in-part of application No. PCT/FR00/02061, filed on Jul. 18, 2000.

(51) Int. Cl.[7] ..... C25D 7/06; C25D 17/28
(52) U.S. Cl. ..... 205/139; 205/145
(58) Field of Search ..... 205/139, 145

(56) References Cited

U.S. PATENT DOCUMENTS 3,867,265 A * 2/1975 Hansson ..... 205/139
4,126,522 A * 11/1978 Edlund ..... 205/139
5,015,340 A * 5/1991 Colombier et al. ..... 205/138

* cited by examiner

*Primary Examiner*—Edna Wong
(74) *Attorney, Agent, or Firm*—Dennison, Schultz, Dougherty & MacDonald

(57) ABSTRACT

A process for continuous nickel plating of an aluminum conductor, by electrolytically pre-treating the aluminum conductor to improve adherence of a nickel coat thereon by passing the aluminum conductor through a pre-treating bath in which is disposed an electrode connected to a first current source at a first voltage, for supplying to the aluminum conductor a pre-treating current, then electrolytically plating the pre-treated aluminum conductor with nickel in a plating bath in which is disposed an anode connected to a second current source at a second voltage, in which a nickel coat is deposited on the conductor by action of a nickel plating current $I_n$. At least the nickel plating current $I_n$ is transmitted to the conductor through a mechanical electrical contact which contacts the conductor between the pre-treating bath and the plating bath, the pre-treating improving the contact properties of the conductor sufficient to permit the transmitting through the mechanical electrical conductor.

40 Claims, 3 Drawing Sheets

CONTINUOUS NICKEL PLATING PROCESS FOR AN ALUMINUM CONDUCTOR AND CORRESPONDING DEVICE

This application is a continuation-in-part of PCT/FR00/02061 filed Jul. 18, 2000.

FIELD OF THE INVENTION

The invention relates to nickel plated aluminum or aluminum alloy conductors. More specifically, it relates to nickel plating processes for aluminum or aluminum alloy conductors, and devices for implementing these processes. The invention also applies to electrical wires and cables with an aluminum or aluminum alloy core comprising at least one nickel plated conductor.

The word "aluminum" covers aluminum and its alloys in the broad sense of the term. It will thus be used throughout the remainder of the text. The word "conductor" in this case refers to an electrically conducting body with an elongated shape and a length that is large compared to its transverse dimensions, such as a wire, strip, bar or tube.

DESCRIPTION OF RELATED ART

Aluminum conductors are widely used for the transmission of electrical and/or thermal energy. These conductors are usually in the form of bars, flats, wires or cables when used as electrical conductors, and in the form of strips, bars or tubes when used as thermal conductors.

In particular, electrical wires and cables with an aluminum core, possibly including a coating made of an insulating material, are usually obtained from continuously cast and rolled "machine" wire that is then drawn to the required diameter. Individual wires or strands can then be assembled together to form the conducting core of a cable.

Aluminum conductors may be used in the untreated state, in other words without any particular surface treatment of the conductor apart from possibly brushing the parts of the conductor on which electrical contact will be made, for most applications such as the transmission and distribution of electrical energy. However for some applications, it is preferable to coat the aluminum conductor with a nickel coat in order to improve the electrical contact properties.

In known continuous nickel plating processes, the conductor advances through at least one electrolytic nickel plating tank. A nickel electrode is installed in this tank and acts as an anode, and consequently it is connected to the positive terminal of an electrical power supply. The conductor to be treated acts as the pure cathode and consequently is electrically connected to the negative terminal of this power supply.

In French patent application FR 2,526,052 (corresponding to U.S. Pat. No. 4,492,615), the applicant proposed a process and a device for continuous electrolytic nickel plating of an aluminum conductor at advance speeds of 300 m/minute. According to this process, the electrolytic current is transmitted to the conductor through connection called a liquid current connection, in other words without any mechanical contact, which avoids the disadvantages of mechanical current connections, and particularly electrical arcs. More precisely, the conductor to be coated is moved inside a first tank in which there is a negatively polarized electrode, and then in a second tank in which there is a positively polarized electrode; an electrical current passes along the conductor as it advances in the bath. The first tank contains an aqueous ionic solution that transmits the electrical current from the electrode to the said conductor. The second tank contains the nickel plating bath.

However, nickel plating of conductors is an additional operation for which the cost should be minimized and the productivity maximized. For wire or cable conductors, satisfactory costs and productivity can be achieved by nickel plating individual wires while moving at high speed. However some markets, for example the aeronautical market, would like to use nickel plated aluminum wires with a diameter of between 0.1 and 0.5 mm, and cables made of such wires.

The method according to French patent application FR 2,526,052 cannot be used satisfactorily to nickel plate wires with a diameter of less than 1 mm with good productivity. The applicant has observed that the quality of the nickel coating is no longer sufficient when the advance speed is more than 20 m/minute. Furthermore, since the entire nickel plating current passes through the conductor to be treated, the risks of the conductor breaking during the treatment increase when the wire diameter drops to less than 1 mm for a given nickel coat thickness, so that the system is unusable if it is desirable to keep the advance speed high (and consequently also keep the nickel plating current high). Moreover, this solution imposes a current in the first tank equal to the nickel plating current in the second tank. The very high surface current density thus achieved causes severe attack on the conductor in the first tank and consequently surface irregularities on the conductor that make it more fragile. Finally, it has been found that the life of the baths is relatively limited in use, particularly due to the high current passing in the first bath and causing deposition of large quantities of precipitates.

In French patent application FR 2,646,174 (corresponding to U.S. Pat. No. 5,015,340), the applicant proposed to solve some of these disadvantages by using baths with an identical composition, one for the first step called the activation step and the other for the next nickel plating step, which is a means of keeping the conductor immersed during its passage from one tank to another. Admittedly, this solution makes it possible to reach advance speeds of the order of 130 m/minute, but it cannot limit the activation current intensity to the values strictly necessary since it is imposed by the intensity of the nickel plating current. This solution does not solve problems related to the liquid current connection.

In French patent application FR 2,609,292 (corresponding to U.S. Pat. No. 4,741,811), the applicant also proposed to modulate the current density along the conductor by reducing the current density in the part on the upstream side of the nickel plating bath and/or on the downstream side of the "activation" bath, and by adjusting the acidity of the nickel plating bath to a pH value of between 1 and 5. In practice, this modulation is achieved by the use of series of electrodes and screens inserted between the electrodes and the conductor. This solution is a means of nickel plating wires with diameters between 0.51 and 0.15 mm at advance speeds of between 25 and 50 m/minute. However, this solution requires a complex device that requires a precise adjustment of the dimensions and the position of components, which in any case can change in time.

In French patent application FR 2,650,696, a process for continuous coating of an aluminum based conductor was proposed comprising a preliminary chemical treatment of the conductor surface to create bond points on the surface in the form of microscopic metallic germs, and deposition of a metallic layer on the conductor by electroplating. The process and the device described in this document present the disadvantages of operating at a low advance speed (immersion times are of the order of 20 to 24 seconds).

SUMMARY OF THE INVENTION

Therefore, the applicant searched for means of obtaining nickel plated aluminum conductors with a diameter of less than 1 mm that avoids the disadvantages of prior art while maintaining acceptable cost effectiveness and productivity with the lowest possible investment costs.

The purpose of the invention is a continuous (or "dynamic") nickel plating process for an aluminum conductor.

More precisely, the continuous nickel plating process for an aluminum conductor according to the invention comprises a pre-treatment step P that improves the adherence of the nickel coat, and an electrolytic nickel plating step N, and is characterized in that the said pre-treatment P can also improve the contact properties of the said conductor sufficiently to enable a mechanical electrical contact, and in that the nickel plating current is transmitted to the said conductor through a mechanical electrical contact on the part of the conductor output from the pre-treatment step.

The electrolytic nickel plating step N forms a uniform nickel coat over the said conductor, by electroplating.

The applicant found that, unexpectedly, due to the pre-treatment operation, it was possible to use mechanical contacts on very small diameter conductors and transmit the entire nickel plating current into the conductor through these contacts (also called "current connections"). The applicant also observed that, surprisingly, this solution could be used for advance speeds significantly greater than 20 m/minute, as illustrated in the example presented later.

Another purpose of the invention is a continuous (or "dynamic") nickel plating device for an aluminum conductor.

Although the invention applies mainly to aluminum conductors intended for electrical applications, it is equally applicable to aluminum conductors intended for non-electrical uses such as thermal uses (that make use of the high thermal conductivity of aluminum, like a heat exchanger), or perhaps specifically mechanical uses.

The invention may also be applied to nickel plating of aluminum products such as wires, strips or tubes made of aluminum to be brazed. In particular, the purpose of the invention is to use the process or device according to the invention for nickel plating of an aluminum product so that it can be brazed. The nickel coat, typically of the order of 1 $\mu$m thick, can be used to form a satisfactory brazed joint without the need for a special brazing flux.

Said aluminum products may be composite products comprising a base part and at least one clad alloy layer (also called brazing alloy). Said composite products are typically used in heat exchangers, especially in the automobile industries. The clad alloy is typically an aluminum-silicon alloy, which typically comprises between about 5 and 13 wt. % silicon (such as AA4343 and 4045 alloys). The nickel coat is deposited on the clad alloy.

A wetting agent may be added to the nickel coat or to the clad alloy layer, or both, in order to improve the wettability of the clad alloy during the brazing process. Said wetting agent is typically an element selected from the group consisting of lead, bismuth, lithium, antimony, tin, silver, thallium and any mixture thereof. When the wetting agent is added to the clad alloy layer the latter typically comprises between 0.01 and 1 wt. % of wetting agent. The wetting agent may be added to the nickel coat by electrolytically depositing both the nickel and the wetting agent. For that purpose the wetting agent may be introduced in the nickel-plating bath, typically as a compound of the wetting agent, such as acetates, citrates, sulfamates, fluoborates, lactates, oxides or mixtures thereof. For example, the following compounds may be used lead acetate, lead citrate, lead sulfamate, lead fluoborate, bismuth lactate or bismuth oxide. The amount of wetting agent compound in the plating bath is typically between 0.1 and 10 g/l.

The nickel coat allows flux-less brazing of magnesium containing composite products in controlled atmosphere brazing ovens (CAB ovens).

Another purpose of the invention is a process for the manufacture of an assembled product including the use of an aluminum product that has been nickel-plated according to the invention. The said manufacturing process may also comprise an operation for brazing the said nickel plated aluminum product. The assembled product may be a heat exchanger when the aluminum conductor is used as a thermal conductor.

DETAILED DESCRIPTION OF THE INVENTION

Figure 1:
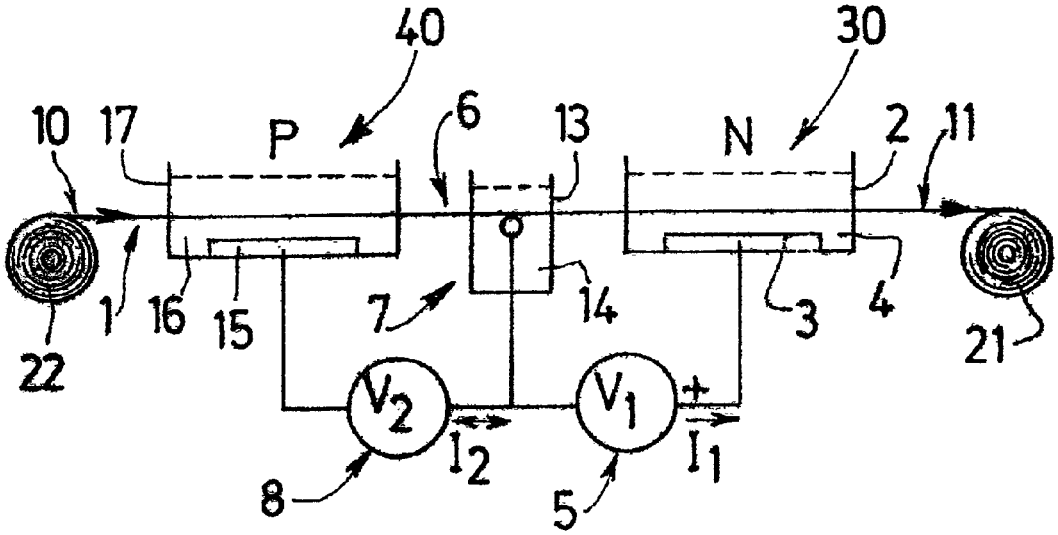
FIG. 1 schematically illustrates a first preferred embodiment of the continuous nickel plating process according to the invention. In this embodiment, the pre-treatment step P is done electrolytically using the same mechanical contact means that are used for the nickel plating step N.

The continuous process for nickel plating of at least one aluminum conductor (1) according to the invention comprises a pre-treatment step P to improve the adherence of a nickel coat and an electrolytic nickel plating step N in which the said nickel coat is deposited on the said conductor by the action of a "nickel plating" current ($I_n$=$I_1$) and is characterized in that the said pre-treatment P also makes the contact properties of the said conductor (1) sufficiently good to enable a mechanical electrical contact, and in that the nickel plating current ($I_n$=$I_1$) is transmitted to the said conductor through a mechanical electrical contact (7), preferably immersed in a liquid (14), on the part (6) of the conductor (1) output from the pre-treatment step P.

The said mechanical contact (7) preferably comprises at least one mechanical rolling contact (70) that typically comprises at least one grooved wheel or a sheave.

Contact properties are sufficiently good when the entire nickel plating current can be passed through the mechanical contact without damaging the conductor. Typically, the mechanical contact must be sufficient to pass a nickel plating current of the order of 5 A for a 0.15 mm diameter wire when the advance speed is 50 m/minute.

For example, the mechanical electrical contact may be made using rollers, wheels, friction contacts or brushes.

The composition of the nickel plating bath is advantageously 300±30 g/l of $Ni(NH_2SO_3)_2$ (sulfamate), 30±5 g/l of $NiCl_2$, $6H_2O$, 30±5 g/l of $H_3BO_3$.

The continuous nickel plating device of at least one aluminum conductor (or "treatment line") according to the invention comprises a nickel plating tank (30) comprising a receptacle (2) that can contain a nickel plating bath (4) and at least one electrode (3) containing nickel, called the anode, at least one electrical power supply (5) to apply an electrical voltage ($V_1$) between the anode and the said conductor, and means (21, 22) for making the conductor or each conductor (1) move forward in the nickel plating bath (4) and is characterized in that it also comprises at least one pre-treatment tank (40, 41, 42) comprising a receptacle (17, 43, 46) that can contain a pre-treatment bath (16, 44, 47), and means of moving the conductor or each conductor forwards in the pre-treatment bath (16, 44, 47), and in that it comprises mechanical contact means (7) of applying the said electrical voltage to the part (6) of the, or each, said conductor (1) output from the pre-treatment step P. Typically, the conductor unwound in the untreated state (10) from at least one turning gear (22) passes through the treatment baths (40, 41, 42, 30) in sequence, and is then wound onto at least one second turning gear (21) in the nickel plated state (11).

The pre-treatment step is chosen such that the contact properties are sufficient to enable a mechanically electrical contact on the conductor.

The pre-treatment step P is preferably done electrolytically, which enables easier control over pre-treatment as a function of operating conditions of the treatment line. In this case, the pre-treatment tank (40) is provided with at least one electrode (15) and the device comprises an electrical power supply (8) intended for pre-treatment. The electrical voltage $V_2$ output by this power supply may be AC, DC or pulsed, or a combination thereof. The current connection on the conductor is made by a mechanical contact placed downstream from the pre-treatment tank (40) This mechanical current connection is advantageously the same as the connection used in the nickel plating step, as illustrated in FIG. 1, which simplifies the device without overloading the mechanical contact means (7) since the intensity of the pre-treatment current ($I_2$) is usually significantly less than the intensity of the nickel plating current ($I_1$).

According to a first variant of the invention, the pre-treatment step P comprises an activation A in a strongly acid or alkaline bath that in particular enables fast dissolution of surface oxides. Activation is done in an activation tank (40, 42) comprising a receptacle (17, 46) that can contain the activation bath (16, 47) in which the conductor (1) advances. When the activation step is done electrolytically, the activation tank (40, 42) also includes at least one electrode (15, 48) and the device comprises an electrical power supply (8) for this activation. The electrical voltage $V_2$ output by this power supply may be AC, DC, or pulsed, or a combination thereof.

According to a second variant of the invention, apart from an activation step A particularly to dissolve oxides present on the surface of the conductor (1), the pre-treatment step P comprises a pre-nickel plating step PN in which the aluminum conductor (1) is coated with a "primary" nickel deposit. The nickel plating current ($I_1$) is then transmitted to the said conductor through mechanical contact means (7) on the part (6) of the conductor (1) coated with the said primary nickel deposit.

The term "primary nickel deposit" means a nickel coat in the form of nodules, with an equivalent thickness significantly less than the intended thickness of the final coat. It has been found preferable to aim at an average equivalent thickness less than about 0.1 of the final thickness. The final coat thickness is typically about 1 $\mu$m, consequently a good equivalent thickness of the pre-nickel plating coat will be less than about 0.1 $\mu$m.

The pre-nickel plating is done in a tank (40, 41) comprising a receptacle (17, 43) that can contain the pre-nickel plating bath (16, 44) in which the conductor (1) advances. The pre-nickel plating bath (16, 44) contains a nickel salt for coating the aluminum conductor with a primary nickel deposit when the conductor moves forwards in this bath.

Preferably, the pre-nickel plating step is done electrolytically, which makes it easier to control the thickness of the layer as a function of the operating conditions of the treatment line. In this case, the pre-nickel plating tank (40, 41) is provided with at least one electrode (15, 45) containing nickel, and the device comprises an electrical power supply (8) N intended for preliminary nickel plating. The electrical voltage $V_2$ output by this power supply may be AC, DC or pulsed, or a combination thereof.

Advantageously, the pre-nickel plating step PN is entirely or partly combined with the activation step A, which considerably simplifies the system. In a preferred variant of this embodiment, the pre-nickel plating and activation steps are done jointly with a liquid current connection.

Figure 2:
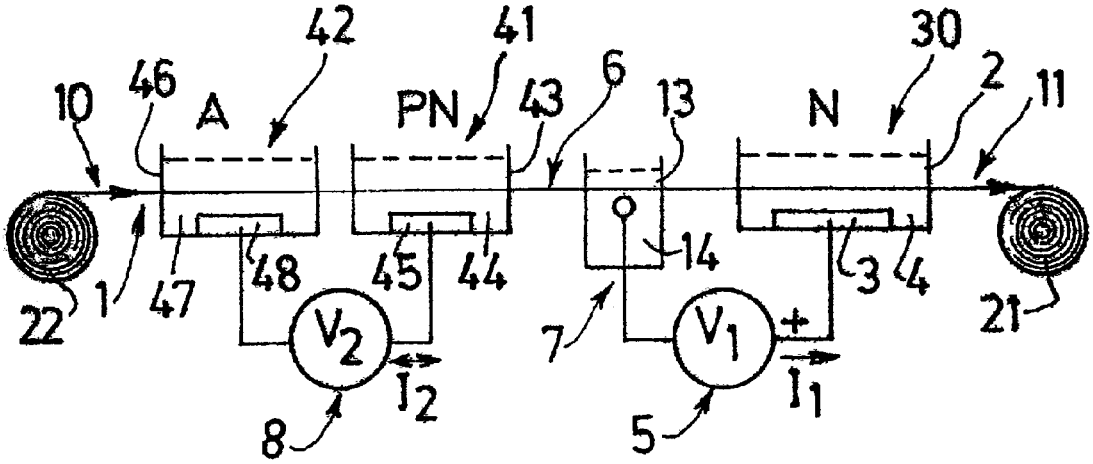
FIG. 2 schematically illustrates a second preferred embodiment of the invention, by which the pre-treatment step P is configured as a liquid current connection.

FIG. 2 illustrates a device for implementing this variant of the invention. This device comprises an electrolytic activation tank (42) and an electrolytic pre-nickel plating tank (41), preferably close to each other and possibly adjacent to each other, a first electrical power supply (8) common to these two tanks, an electrolytic nickel plating tank (30), a second electrical power supply (5) and mechanical contact means (7) on the part (6) of the conductor (1) located between the pre-nickel plating tank (41) and the nickel plating tank (30).

The first electrical power supply (8) is preferably a DC power supply, possibly modulated or pulsed; the positive terminal is connected to at least one electrode (45), that is fully or partly immersed in the pre-nickel plating bath (44), and the negative terminal is connected to at least one electrode (48) wholly or partly immersed in the activation bath (47). The current passes through the conductor (1) by a liquid current connection effect. Thus, the same electrical power supply (8) is used for activation and pre-nickel plating.

The second electrical power supply (5) is a DC current, possibly modulated or pulsed; the positive terminal is connected to at least one electrode (3) containing nickel, fully or partly immersed in the nickel plating bath (4), and the negative terminal is connected to the part (6) of the conductor (1) located between the pre-nickel plating tank (41) and the nickel plating tank (30) by mechanical contact means (7, 13, 14).

For the variant illustrated in FIG. 2, it was found advantageous to use the following composition for activation and pre-nickel plating baths: 125±15 g/l of nickel chloride ($NiCl_2$, $6H_2O$), 12.5±2 g/l of orthoboric acid and 6±2 ml/l of hydrofluoric acid.

The pre-nickel plating step PN and the activation step A can be done simultaneously in the same bath (40) with common electrodes (15) (with the same polarization) as illustrated in FIG. 1. In this case, the pre-treatment step performs the activation and pre-nickel plating functions. The activation/pre-nickel plating bath (16) can then perform the two treatments, for example with a mixed composition that enables satisfactory activation and sufficient pre-nickel plating. The applicant observed that it was possible to carry out these two functions efficiently using a single bath. The following composition gave excellent results: 125±15 g/l of nickel chloride ($NiCl_2$, $6H_2O$), 12.5±2 g/l of orthoboric acid and 6±2 ml/l of hydrofluoric acid.

In this variant, the first electrical power supply (8) is DC, possibly modulated or pulsed, the positive terminal being connected to the conductor (1) through the mechanical contact (7) and the negative terminal being connected to at least one electrode (15) immersed entirely or partly in the said activation/pre-nickel plating bath (16). The second electrical power supply (5) is a DC current, possibly modulated or pulsed; the positive terminal is connected to an electrode (3) containing nickel, wholly or partly immersed in the nickel plating bath (4) and the negative terminal is connected to the part (6) of the conductor (1) located between the activation/pre-nickel plating tank (40) and the nickel plating tank (30) by mechanical contact means (7), preferably common with those in the first power supply (8).

For conductors with a very small cross-section, particularly for wires with a diameter of less than 0.2 mm, it is preferable if the mechanical contact is immersed in a liquid (14) such as water or a neutral solution in order to prevent the conductor from melting at the mechanical contact. The device may comprise an intermediate receptacle (13), usually with small dimensions, for this purpose containing the liquid (14) and the mechanical contact (7). The liquid (14) may be cooled.

The applicant also noted that it is preferable to use mechanical contact means that minimize friction between the contact means and the conductor in order to achieve high advance speeds, since a high coefficient of friction can cause melting of the conductor even when the electrical contact is immersed in a liquid. It was found particularly advantageous to use mechanical contacts comprising at least one wheel, preferably a grooved wheel, and particularly like that illustrated in FIGS. 3 and 4. The use of contact wheels eliminates problems due to sparking and deterioration of the conductor surface after the pre-treatment.

Figure 3:
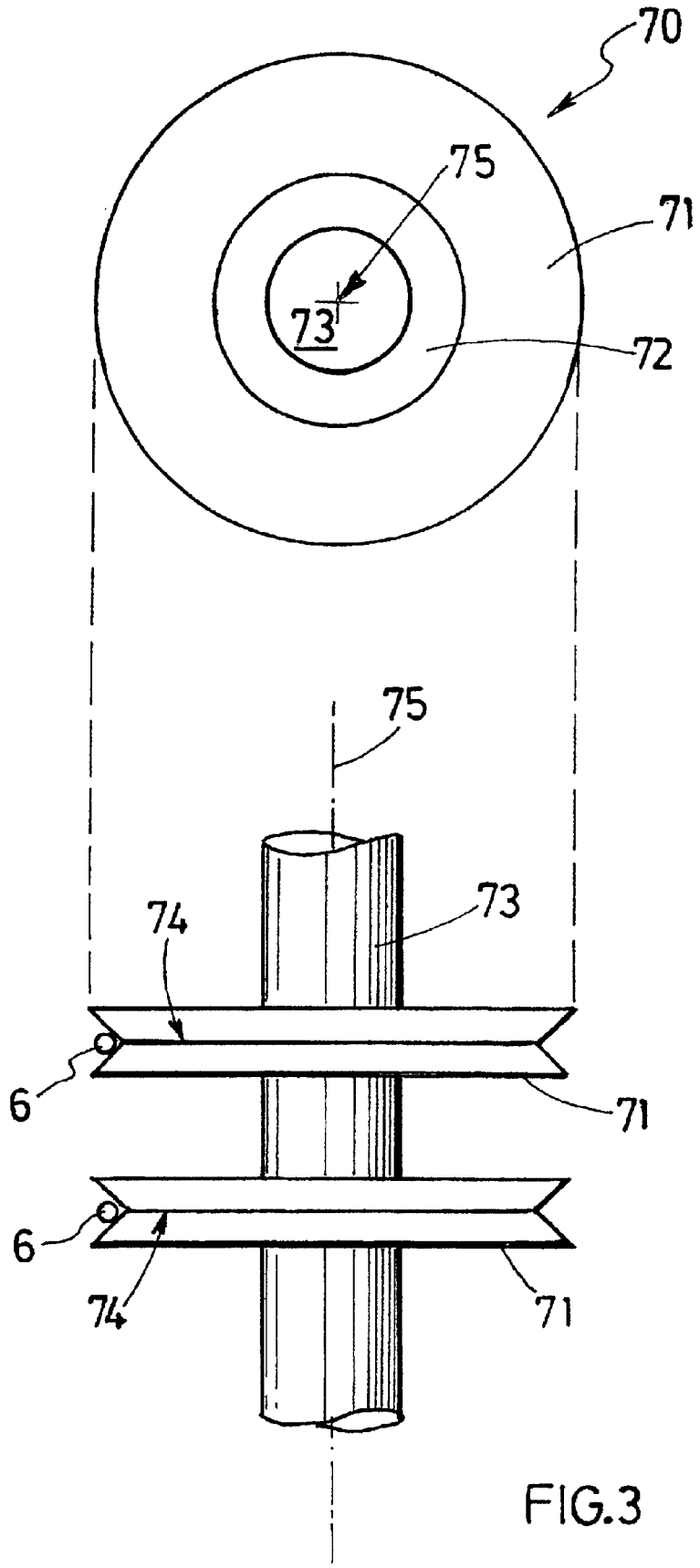
FIG. 3 illustrates a mechanical contact means according to the invention comprising one or several wheels.

For the treatment of two or more conductors in parallel (treatment "in layer"), the mechanical contact can comprise several parallel wheels rotating about a common axis (like that illustrated in FIG. 3).

The mechanical rolling contact means illustrated in FIG. 3, that shows a preferred embodiment of the invention, comprises one or several wheels (71) rotating around an axle (73), the central axis (75) of the axle being approximately perpendicular to the said wheels (71). The wheel (71), or each wheel, is preferably provided with a groove (74) inside which the part (6) fits under pressure, which in particular prevents variations in the position of the conductor. The electrical current passes from the axle (73) to the part (6) through the wheel (71). The axle-wheel(s) assembly (70) may be immersed in a liquid (14). The contact means may comprise a ring (72), typically made of graphite, to make it easier for the wheels (71) to rotate about the axle (73) and improve the electrical contact. This variant also avoids the use of a ball bearing. In tests carried out by the applicant, the wheels used (71) were made of copper (possibly nickel plated) and the axle (73) was made of stainless steel.

Figure 4:
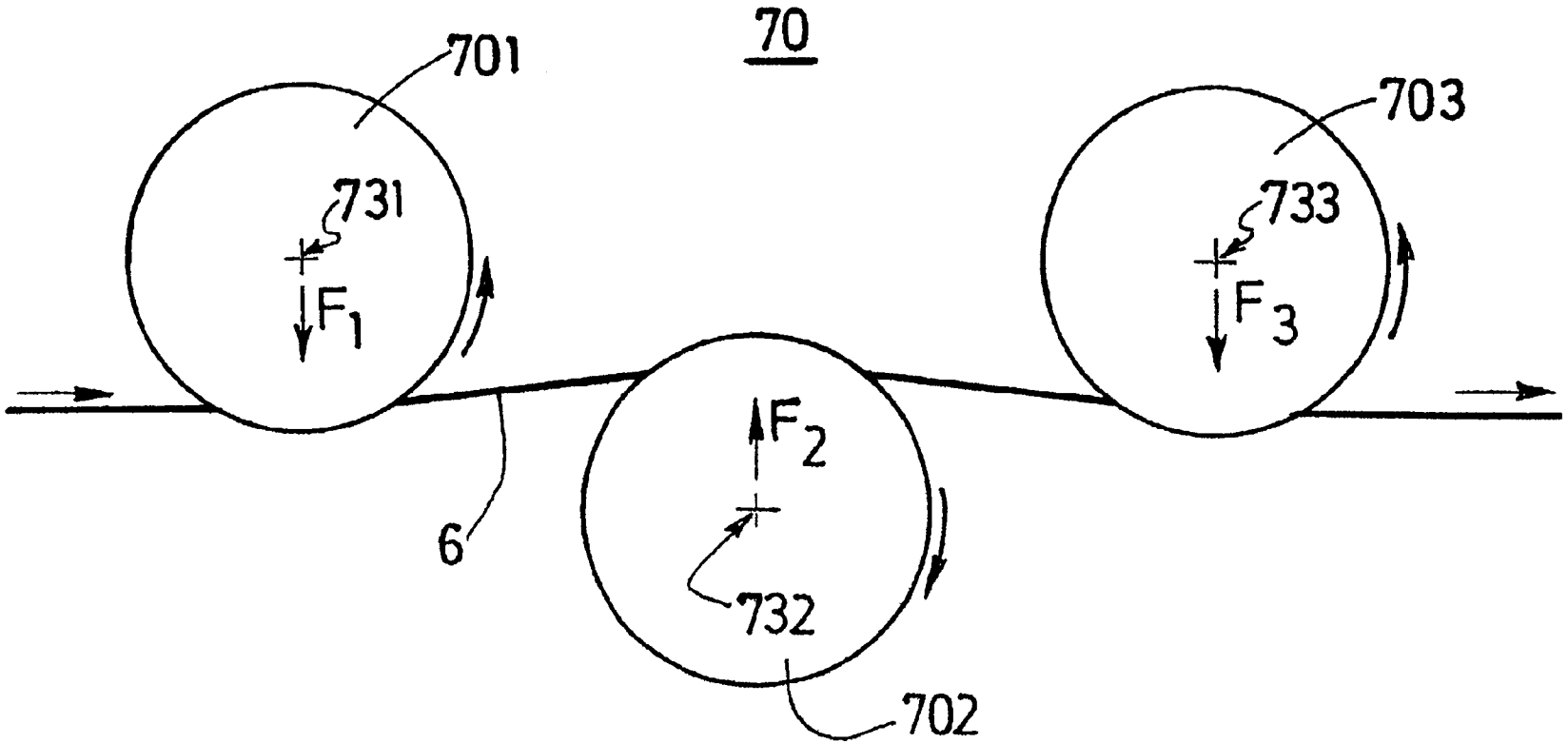
FIG. 4 illustrates another contact means according to the invention comprising three wheels.

The mechanical contact means illustrated in FIG. 4, that also shows a preferred embodiment of the invention, comprises a set of at least three wheels (701, 702, 703) that work together to give a satisfactory electrical contact on the conductor (6), or each conductor. Preferably, each conductor comprises this type of means when several conductors are treated simultaneously. At least one of the said mechanical contact means (7) comprises this type of contact. Each wheel rotates around its own axis (731, 732, 733) and applies a force (F1, F2, F3) on the conductor. In practice, it is sufficient to adjust the force exerted on the conductor, by moving the central wheel (702) alone. The three wheels can be immersed in a liquid (14).

The temperature of the various baths is usually chosen such that the ionic conductivity and the reactivity of the baths are sufficient. Typically, the bath temperature is between 45 and 60° C.

The process according to the invention may include additional steps such as shaving and/or degreasing of the conductor in the untreated state (10) before the activation and/or pre-nickel plating step.

The conductor is typically an AA 1370, AA 1110 or AA 6101 alloy according to the nomenclature used by the Aluminum Association.

Another purpose of the invention is cables comprising at least one elementary nickel plated wire according to the invention. In particular, the fabrication process for an aluminum electrical cable may include a nickel plating operation according to the invention on at least one of the elementary wires.

According to another variant of the invention, several conductors are treated simultaneously, particularly in pre-treatment and nickel plating baths. For example, two or more conductors can be placed in parallel for this purpose, the said conductors can pass simultaneously from one tank to the next using separate means of advancing each conductor, or common means for all conductors. In other words, the device includes means of making two or several conductors move forward simultaneously in at least one of the said treatment tanks. For example, layers of conductors originating from a series of distinct turning gears circulate in parallel in the said baths, and after treatment are wound onto a series of separate turning gears. The contact means (7) on the part (6) of the conductors output from the pre-treatment step may be wholly or partly common to the conductors; for example, the said means may comprise a strip of carbonated material that can be put into contact with all conductors in a layer.

The conductor(s) may move horizontally, vertically, or at an angle from the horizontal.

EXAMPLE 1

Tests have been carried out on a 0.20 mm diameter wire according to prior art and according to the invention.

In the tests according to prior art, the intensity of activation and nickel plating currents were the same and originated from a common power supply configured as a liquid current connection (as described in application FR 2 646 174); screens were inserted between the nickel electrodes and the wire (as described in application FR 2 609 292). The compositions of the activation bath and the nickel plating bath were the same, namely 125±15 g/l of nickel chloride ($NiCl_2$, 6 $H_2O$), 12.5±2 g/l of orthoboric acid and 6±2 ml/l of hydrofluoric acid.

The tests according to the invention were carried out using a device similar to that in FIG. 2. The electrodes (48) of the activation tank (42) were made of graphite and the electrodes (45) of the pre-nickel plating tank (41) were made of nickel. The composition of the activation bath and the pre-nickel plating bath was 125±15 g/l of nickel chloride ($NiCl_2$, 6 $H_2O$), 12.5±2 g/l of orthoboric acid and 6±2 ml/l of hydrofluoric acid. The composition of the nickel plating bath was 300±30 g/l of $Ni(NH_2SO_3)_2$ (sulfamate), 30±5 g/l of $NiCl_2$, $6H_2O$, 30±5 g/l of $H_3BO_3$.

Table I below shows the main treatment parameters used in the tests and some characteristics of the treated wires. The contact resistance was measured using a "wire cross" method with a current of 0.1 mA and a contact force of 0.2 N. The adherence of the nickel coat on the wire was measured by winding the wire around its own diameter; it is considered to be excellent if the nickel coat follows the deformation of the wire uniformly without becoming detached from the surface.

TABLE 1

| | Prior art | Invention |
|---|---|---|
| Advance speed (m/min) | 50 | 80 |
| Intensity of the activation-nickel plating current (A) | 12.5 | not applicable |
| Intensity of the pre-treatment current (A) | not applicable | 3–10 |
| Intensity of the nickel plating current (A) | Not applicable | 15–30 |
| Average thickness of deposit (μm) | 0.8 | 0.8 |
| Average contact resistance (mΩ) | 15 | 15 |
| Adherence of deposit | excellent | excellent |

In the tests according to prior art, it was impossible to carry out the treatment at an advance speed as high as 80 m/min.

It was observed that the deposit was "burned" at this speed, in other words a black non-adherent deposit was produced caused by an excessive current density in the activation step.

The pre-nickel plating coat obtained electrolytically is in the form of nodules that do not cover the entire surface of the conductor. The applicant observed that there was no need for the said primary nickel deposit (or "pre-nickel plating coat") to be uniform or for it to cover the entire surface of the conductor; it is sufficient to achieve an equivalent coverage ratio corresponding to about 0.1 times the final thickness of the nickel coat. The applicant suggested that this coverage rate would result in a sufficiently good quality of the electrical contact to enable transmission of high nickel plating current intensities by mechanical contact without degrading the surface of the conductor, and give a high adherence of the final nickel coat. Thus, the term "primary nickel deposit" means a nickel coat with a typically average thickness equal to about 0.1 μm.

Therefore the nickel coat obtained according to the invention has a good adherence and a low electrical contact resistance.

With the invention, nickel plating can be applied with high productivity to different diameters of wires. In particular, treatment parameters can easily be adjusted to satisfy production conditions, due to decoupling between the pre-treatment and nickel plating steps. In particular, it is possible to adjust the intensity of the pre-treatment and nickel plating currents independently, and particularly to impose a low current intensity in the pre-treatment step and a high current intensity in the nickel plating step.

With this invention, it is possible to benefit from the advantages of mechanical current connections, particularly the possibility of passing high intensities and avoiding their disadvantages, particularly the likelihood of electrical arcs being formed, that can damage the conductor surface.

The low intensity of the pre-treatment current required according to the invention means that the rate of aluminum enrichment of the pre-treatment bath is significantly lower, so that the replacement frequency of this bath can be very much reduced. The low intensity of the pre-treatment current also limits dissolution of the metal and consequently the creation of roughness on the wire surface. In other words, a given roughness of the conductor surface can also be achieved during the pre-treatment step according to the invention, to optimize mechanical properties.

What is claimed is:

1. A process for continuous nickel plating of an aluminum conductor, comprising the steps of:

electrolytically pre-treating the aluminum conductor to improve adherence of a nickel coat thereon by passing the aluminum conductor through a pre-treating bath in which is disposed an electrode connected to a first current source at a first voltage, for supplying to the aluminum conductor a pre-treating current;

electrolytically plating the pre-treated aluminum conductor with nickel in a plating bath in which is disposed an anode connected to a second current source at a second voltage, in which a nickel coat is deposited on the conductor by action of a nickel plating current $I_n$, and transmitting at least the nickel plating current $I_n$ to the conductor through a mechanical electrical contact which contacts the conductor between the pre-treating bath and the plating bath, wherein said pre-treating improves contact properties of the conductor sufficient to permit the transmitting through the mechanical electrical conductor.

2. The process according to claim 1, wherein the pre-treatment step comprises an activation in a strong acid or alkaline bath to enable fast dissolution of surface oxides.

3. The process according to claim 1, wherein the pre-treatment step comprises a pre-nickel plating step to coat the aluminum conductor with a primary nickel deposit.

4. The process according to claim 3, wherein the equivalent average thickness of the said primary nickel deposit is less than about 0.1 μm.

5. The process according to claim 1, wherein the pre-treatment step comprises an activation in a strong acid or alkaline bath to enable fast dissolution of surface oxides and a pre-nickel plating step in a pre-nickel plating bath that coats the aluminum conductor with a primary nickel deposit, and wherein the pre-nickel plating step and the activation step are done jointly and electrolytically with a liquid current connection.

6. The process according to claim 5, wherein the compositions of the activation bath and the pre-nickel plating bath are substantially the same.

7. The process according to claim 5, wherein the equivalent average thickness of said primary nickel deposit is less than about 0.1 μm.

8. The process according to claim 1, wherein the pre-treatment step comprises an activation in a strong acid or alkaline bath to enable fast dissolution of surface oxides and a pre-nickel plating step in which the aluminum conductor is coated with a primary nickel deposit, and wherein the pre-nickel plating step and the activation step A are done simultaneously in the same bath.

9. The process according to claim 8, wherein the equivalent average thickness of said primary nickel deposit is less than about 0.1 μm.

10. The process according to claim 1, wherein the mechanical contact is immersed in an optionally cooled liquid.

11. The process according to claim 1, wherein said mechanical electric contact comprises at least one mechanical rolling contact means.

12. The process according to claim 1, wherein several aluminum conductors are treated simultaneously.

13. The process according to claim 1, wherein the aluminum conductor is made of an alloy selected from the group consisting of AA 1370, AA 1110 and AA 6101 according to the nomenclature of the Aluminum Association.

14. A process for manufacturing an aluminum electrical cable comprising:

providing an elementary wire or strand as said aluminum conductor;

nickel plating said wire or strand using the process according to claim 1;

making said cable using said at least one nickel plated elementary wire or strand.

15. The process according to claim 1, wherein said aluminum conductor is an aluminum strip or aluminum tube.

16. The process according to claim 1, wherein said aluminum conductor is a composite aluminum product comprising a base part and at least one clad aluminum alloy layer.

17. The process according to claim 16, wherein the clad alloy layer comprises a wetting agent.

18. The process according to claim 17, wherein the wetting agent is selected from the group consisting of lead, bismuth, lithium, antimony, tin, silver, thallium and any mixture thereof.

19. The process according to claim 17, wherein the clad alloy layer comprises between 0.01 and 1 wt. % of wetting agent.

20. The process according to claim 16, wherein the clad alloy layer comprises an aluminum-silicon alloy.

21. The process according to claim 1, wherein the nickel plating step is performed using a nickel plating bath containing a compound of a wetting agent, so as to deposit a nickel coat containing a wetting agent onto the aluminum conductor.

22. The process according to claim 21, wherein compound is selected from the group consisting of the acetates, citrates, sulfamates, fluoborates, lactates, oxides and mixtures thereof.

23. The process according to claim 22, wherein said aluminum conductor is a composite aluminum product comprising a base part and at least one clad aluminum alloy layer.

24. The process according to claim 23, wherein the clad alloy layer comprises an aluminum-silicon alloy.

25. The process according to claim 23, wherein the clad alloy layer comprises a wetting agent.

26. The process according to claim 25, wherein the wetting agent is selected from the group consisting of lead, bismuth, lithium, antimony, tin, silver, thallium and any mixture thereof.

27. The process according to claim 25, wherein the clad alloy layer comprises between 0.01 and 1 wt. % of wetting agent.

28. A process for manufacturing an assembled product comprising the steps of:

providing as said aluminum conductor a composite aluminum product comprising a base part and at least one clad aluminum alloy layer; and nickel plating said composite product according to the process of claim 1.

29. The manufacturing process according to claim 28, wherein the clad alloy layer comprises a wetting agent.

30. The manufacturing process according to claim 29, wherein the wetting agent is selected from the group consisting of lead, bismuth, lithium, antimony, tin, silver, thallium and mixtures thereof.

31. The manufacturing process according to claim 29, wherein the clad alloy layer comprises between 0.01 and 1 wt. % of wetting agent.

32. The manufacturing process according to claim 28, wherein the clad alloy layer comprises an aluminum-silicon alloy.

33. The manufacturing process according to claim 28, wherein said composite product is in the form of a strip or a tube.

34. The manufacturing process according to claim 28, wherein the nickel plating is performed using a nickel plating bath containing a compound of a wetting agent, so as to deposit a nickel coat containing a wetting agent onto the aluminum conductor.

35. The manufacturing process according to claim 34, wherein the compound is selected from the group consisting of acetates, citrates, sulfamates, fluoborates, lactates, oxides and mixtures thereof.

36. The manufacturing process according to claim 34, wherein the clad alloy layer comprises a wetting agent.

37. The manufacturing process according to claim 36, wherein the wetting agent is selected from the group consisting of lead, bismuth, lithium, antimony, tin, silver, thallium and any mixture thereof.

38. The manufacturing process according to claim 36, wherein the clad alloy layer comprises between 0.01 and 1 wt. % of wetting agent.

39. The manufacturing process according to claim 28, wherein the assembled product is a heat exchanger.

40. The manufacturing process according to claim 28, further comprising brazing said composite product.

* * * * *